US005893563A

United States Patent [19]

Buller

[11] Patent Number: 5,893,563

[45] Date of Patent: Apr. 13, 1999

[54] GAME APPARATUS FOR USE WITH THROWN OBJECTS

[75] Inventor: Matthew A. Buller, 1013 N. Florence Pl., Tulsa, Okla. 74110

[73] Assignee: Matthew A. Buller, Tulsa, Okla.

[21] Appl. No.: 08/996,072

[22] Filed: Dec. 22, 1997

[51] Int. Cl.[6] ..... A63B 67/06

[52] U.S. Cl. ..... 273/400

[58] Field of Search ..... 273/400

[56] References Cited

U.S. PATENT DOCUMENTS 4,039,189 8/1977 Headrick et al. ..... 273/400

4,323,250 4/1982 Lansberry ..... 273/400

*Primary Examiner*—William H. Grieb

*Attorney, Agent, or Firm*—Richard L. Myers

[57] ABSTRACT

A game apparatus adapted for use with objects to be thrown includes a primary panel having a first end and a second end, a secondary panel connected to the first end and forming a tray to receive the thrown objects. A tertiary panel is disposed at the second end and has a perimeter region to which a plurality of elongate obstruction elements are attached. These elements extend into proximity with the secondary panel and form a barrier through which the objects are intended to be thrown. A tension mechanism can be applied to the obstruction elements and a target hole provided in the tertiary panel. Folded configurations of the apparatus facilitate compaction, transportation, and storage of the objects.

19 Claims, 3 Drawing Sheets

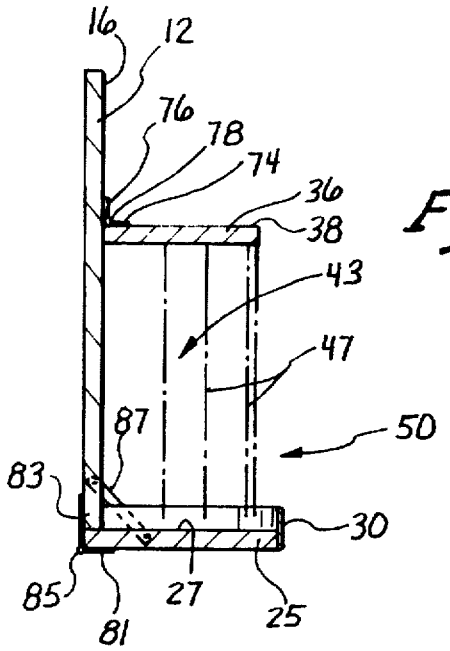
Fig. 4
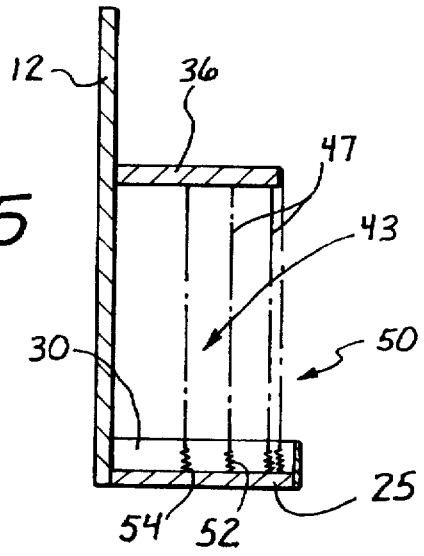
Fig. 5
Fig. 6
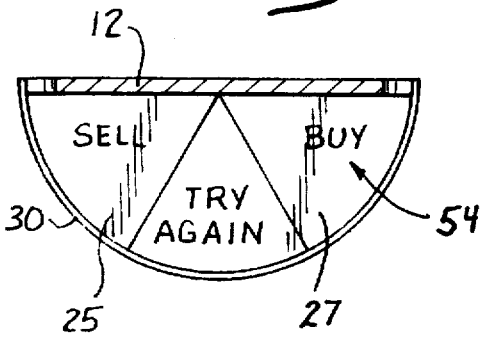
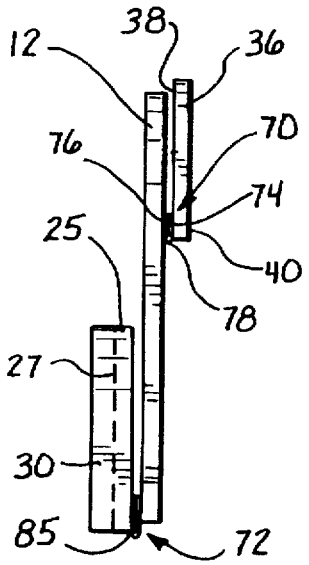
Fig. 7

GAME APPARATUS FOR USE WITH THROWN OBJECTS

BACKGROUND OF THE INVENTION

1. Field of the Invention

This invention relates generally to game apparatus and more specifically to game apparatus adapted to be used with thrown objects where the purpose of the game is to penetrate a barrier with the thrown object to reach an interior region of the apparatus.

2. Discussion of the Prior Art

Many games are played with apparatus that are intended to provide targets for objects to be thrown at the apparatus. In the game of horseshoes, for example, a stake provides a target for horseshoes which are thrown at the stake.

Other types of game apparatus form a barrier between the player and the target. In this type of apparatus, the object must not only be thrown at the target but also be delivered with sufficient accuracy to penetrate the barrier. One such game apparatus is commonly referred to as Frisbee® Golf, where the object to be thrown is a common disk and the target has a special construction, including a penetrable barrier. More specifically, the target includes a supporting pole and a top panel having a perimeter region from which are hung a plurality of chains that extend under the force of gravity into proximity with a bottom panel which forms a tray. Both the top panel and the bottom panel have circular configurations which are symmetrical about an axis passing through the support pole. This enables the target to be addressed from any side. In Frisbee® Golf, opponents play the game by facing the same target. For this reason, the target is not adapted to be addressed from only one direction as is the case with opponents in the game of horseshoes, which face each other and address separate targets.

The apparatus used in Frisbee® Golf is intended for use out of doors and is not adapted for disposition within an office. In doors, there is usually not sufficient space to enable a support pole to be placed in the middle of a room. The targets associated with the prior art are not adapted to be positioned next to a wall as they are designed to be addressed from any position around the support pole.

SUMMARY OF THE INVENTION

In accordance with this invention, a target providing a penetrable barrier is adapted for disposition next to a wall or on a table. The target is designed to be addressed from only a single direction such as any location spaced from the wall. The target is also adapted for use in pairs with opposing targets and opponents facing each other.

The apparatus typically includes a back panel, a bottom panel forming a tray and a top panel having a perimeter region from which elongate obstruction elements are hung. These obstruction elements are spaced a predetermined distance which will typically be less than the size of the object to be thrown. As a result, in order for an object to reach the interior region of the apparatus, the obstruction elements must separate laterally to permit penetration by the object. This separation can be controlled by varying the spacing of the elements and also by providing a tension mechanism between each element and the bottom panel. The tension mechanism would tend to inhibit lateral separation of the obstruction elements and consequently penetration of the barrier by the object.

In one aspect, the invention includes a game apparatus adapted for use with an object to be thrown. The apparatus includes a primary panel having a first end and a second end. A secondary panel is disposed in proximity to the first end of the primary panel, the secondary panel extending in cantilevered relationship to the primary panel to form a tray. A tertiary panel is disposed in proximity to the second end of the primary panel. A tertiary panel has a perimeter region from which a plurality of elongate obstruction elements are hung. These elements extend into proximity with the secondary panel and form a barrier defining with the primary panel a targeted interior region. The objects are to be thrown at the apparatus with a purpose of penetrating the barrier in order to reach the targeted interior region of the apparatus.

In another aspect, the invention includes a support having a first end and a second end. A top panel is coupled to the first end and has an interior region. A bottom panel is coupled to the second end in spaced relationship with the top panel and forms a tray. A plurality of obstruction elements are coupled to the perimeter region of the top panel and define at least in part a targeted interior region of the apparatus. A tensioning mechanism is coupled to one of the elongate elements to inhibit separation of the one element and any adjacent element thereby increasing the degree of difficulty in penetrating the barrier.

In a further aspect of the invention, the top panel and bottom panel have first and second configurations, respectively. The first configuration of the top panel is smaller in size than the second configuration of the bottom panel; however, the two configurations are geometrically similar in shape.

The game apparatus of this invention is easily adapted for disposition in an office, for example, by hanging the apparatus on a wall or supported on a table. The degree of difficulty in reaching the targeted interior region can be controlled by spacing and tensioning the elements forming the barrier. The tray can be labeled with indicia, facilitating the selection of alternative decisions.

These and other features and advantages of the invention will be more apparent with the description of preferred embodiments and reference to the associated drawings.

DESCRIPTION OF THE DRAWINGS

FIG. 4 is a side elevation view of the game apparatus illustrated in FIG. 1;

FIG. 5 is a side elevation view similar to FIG. 4 and illustrating tension mechanisms applied to the obstruction elements in another embodiment of the invention;

FIG. 6 is a top plan view of the bottom tray illustrating possible alternative decisions displayed in the targeted interior region of the apparatus;

FIG. 7 is a side elevation view illustrating a hinged embodiment facilitating a planar folded configuration in a further embodiment of the invention;

DESCRIPTION OF THE PREFERRED EMBODIMENTS

Figure 1:
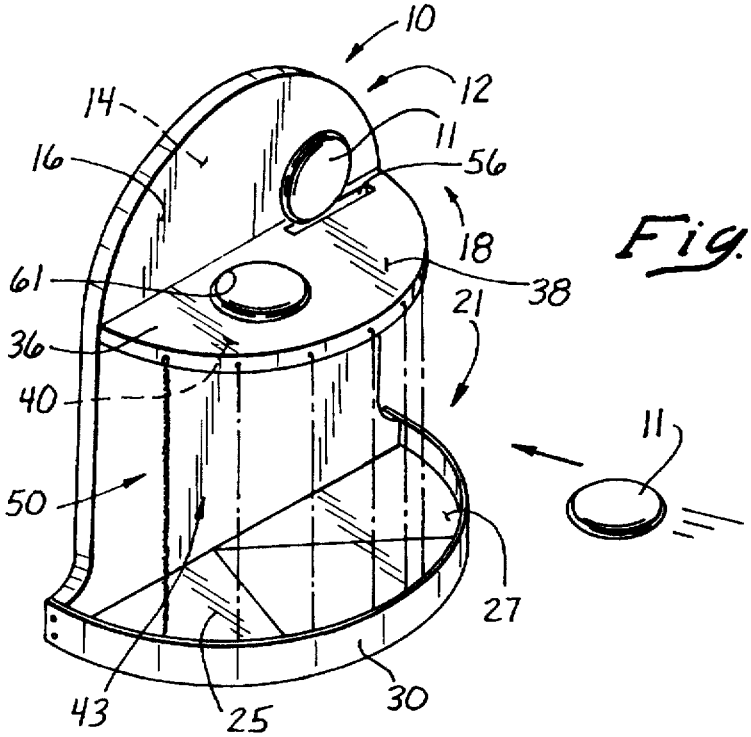
FIG. 1 is a perspective view of one embodiment of the game apparatus including a back panel, a bottom panel forming a tray, and a top panel having a perimeter region from which are hung a plurality of obstruction elements forming a barrier.
Figure 2:
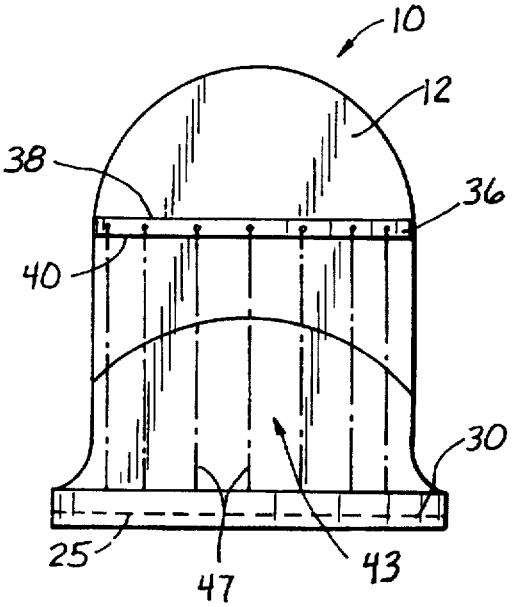
FIG. 2 is a front elevation view of the game apparatus illustrated in FIG. 1.

A game apparatus is illustrated in FIG. 1 and designated generally by the reference numeral 10. The apparatus 10 is adapted for use with objects to be thrown, such as balls or the small disks illustrated in FIG. 1 and designated by the reference numeral 11. The apparatus 10 includes a primary support panel 12 having primary surface 14 facing rearwardly of the apparatus 10 and an opposing primary surface 16 facing forwardly of the apparatus 10. The support panel 12 extends between a first end 18 at the top of the apparatus 10 and a second end 21 at the bottom of the apparatus 10.

A second panel 25, disposed at the second end 21, is cantilevered from the support panel 12 and extends outwardly of and generally perpendicular to the surface 16. With this configuration, the second panel 25 tends to form a tray having an upper surface 27 which is adapted to receive the disks 11 that are thrown at the apparatus 10. A strip 30, formed of metal or other bendable material, can be provided around the edge of the bottom panel 25 to form a lip which extends above the surface 27 to retain the disks 11 falling onto the surface 27 of the tray or panel 25.

A third panel 36 can be coupled in cantilevered relationship to the support panel 12 and in spaced relationship to the second panel 25. The third panel 36 will typically extend outwardly of and generally perpendicular to the primary surface 16 at the first end 18 of the panel 12. An upwardly facing surface 38 of the panel 36 tends to form a shelf for the apparatus 10 while a bottom facing surface 40 of the panel 36 tends to form an interior target region with the surface 16 and the surface 27 between the panels and 36. This target region 43 is further defined by a plurality of obstruction elements such as chains 47 which hang from a perimeter region 48 of the panel 36 downwardly into proximity with the surface 27 of the panel 25.

Collectively, the chains 47 form a barrier 50 through which the objects or disks 11 must be thrown in order to reach the target region 43. The chains 47 are spaced by a predetermined distance which is generally dependent on the size of the thrown objects, such as the disks 11. Where the disks 11 have a diameter of about three inches, the chains 47 may be separated by a distance such as two and one-half inches.

The degree of difficulty encountered in penetrating the barrier 50 formed by the chains 47, will depend upon the size and shape of the objects to be thrown. If the object is a spherical ball and the chains 47 are spaced a distance less than the diameter of the ball, then the barrier 50 can only be penetrated by having adjacent pairs of the chains separate laterally. In the case of a disk 11, which has a generally planar configuration, the barrier 50 can be penetrated if the disk 11 passes between the chains in a vertical orientation. However, disks 11 typically are thrown with a horizontal orientation. In order to penetrate the barrier with this orientation, adjacent pairs of the chains 47 will need to separate laterally in order to permit penetration of the barrier 50.

The ability of adjacent pairs of the chains 47 to separate laterally is dependent on several factors. Of course, the predetermined distance of separation between adjacent chains 47 and the size of the object, such as the disk 11, will determine the degree of lateral separation required. The size and weight of the chains 47 will also affect the degree of lateral movement which can be caused by the thrown object. In order to make the barrier more penetrable, the predetermined spacing of adjacent chains 47 can be increased, the size of the chain links can be reduced and the weight of the chains 47 can also be reduced. These factors can work together to make it easier for the object, such as the disk 11, to penetrate the barrier 50 formed by the obstruction elements or chains 47. Of course any elongate element such as string, rope or cable, could be used in place of the chains 47 to form a suitable barrier 50.

Another way of controlling the penetrability of the barrier 50 is to provide some tensioning mechanism for the obstruction elements or chains 47. Any mechanism increasing the tension of the chains 47 will function to inhibit the lateral movement required to penetrate the barrier 50. In an embodiment illustrated in FIG. 5, a plurality of springs 52 are provided, one for each of the chains 47. These springs are connected between the chains 47 and the bottom panel 25, thereby biasing the obstruction elements 47 to a straight configuration. Of course the springs are capable of elongation as required to separate adjacent chains 47 and permit penetration of the barrier 50 by the disk 11. Other tension mechanisms might include the provision of a weight 54 attached to the bottom end of a chain 47. Such a weight 54 would also have the effect of tensioning the associated chain 47 and thereby inhibiting the lateral movement necessary for penetration of the barrier 50.

As illustrated in FIG. 6, the surface 27 of the panel 25 can be printed with indicia 54 which describes alternative decisions such as "buy," "sell," or "try again." The object of such indicia might be to aid the user in making a decision.

Figure 3:
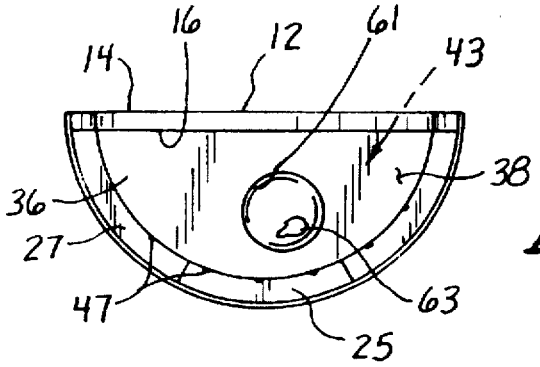
FIG. 3 is a top plan view of the game apparatus illustrated in FIG. 1.

In a preferred embodiment, the top panel 36 has a first configuration and the bottom panel 25 has a second configuration. As illustrated in FIG. 3, these configurations may take the form of semicircles where the top panel 36 is smaller in size but similar in shape to the bottom panel 25. With these relative configurations, attachment of the chains 47 to the perimeter region of the panel 36 will cause the chains to hang into proximity with the surface 27 equally spaced from the perimeter or circumferences of the panel 25.

For purposes of packaging and transportation, it may desirable to provide the apparatus 10 in a configuration which can be folded relatively flat. As best illustrated in FIG. 4, the apparatus can be provided with a pair of hinges 70 and 72 facilitating collapse of the apparatus from an operative position illustrated in FIG. 4 to a generally flat configuration illustrated in FIG. 7. The hinge 70 can be of the butterfly-type having a pair of flanges 74, 76 rotatable about a pivot pin 78. The flange 74 can be attached to the panel 36 and the flange 76 attached to the panel 12. In this configuration, the pivot pin 78 will be positioned generally at the intersection of the surface 16 and the surface 38. With this orientation, the panel 36 can be pivoted upwardly into a generally parallel configuration with the panel 12.

The hinge 72 can also be of the butterfly-type including flanges 81 and 83 rotatable about a pivot pin 85. With the panel 25 extending beneath the panel 12, the flange 81 can be attached to the panel 25 and the flange 83 attached to the panel 12. With this orientation, the pivot pin 85 is positioned along the lower outer edge of the panel 25. It will be noted in this orientation that the flange 83 extends along both the panel 12 and the panel 25. Importantly, it must be attached only to the panel 12 so that the panel 25 is free to pivot about the pin 85. Pivoting the panel 25 clockwise in FIG. 4 about the pin 85 will bring the panel 25 into a generally parallel orientation with the panel 12 as illustrated in FIG. 7. As noted, the parallel orientation of the panels 12, 25 and 36, illustrated in FIG. 7, will greatly facilitate packaging as well as transportation of the apparatus 10. From this parallel orientation, the apparatus 10 can be unfolded to its operative position by lowering the shelf 36. The force of gravity will hold the shelf 36 in its operative position illustrated in FIG. 4. Moving the shelf 25 counterclockwise from the compact orientation illustrated in FIG. 7, will bring the shelf 25 to its operative position as illustrated in FIG. 4. In order to oppose the force or gravity on this panel 25, a removable locking strap can be provided to extend between the panel 12 and the panel 25 as illustrated in FIG. 4.

Figure 8:
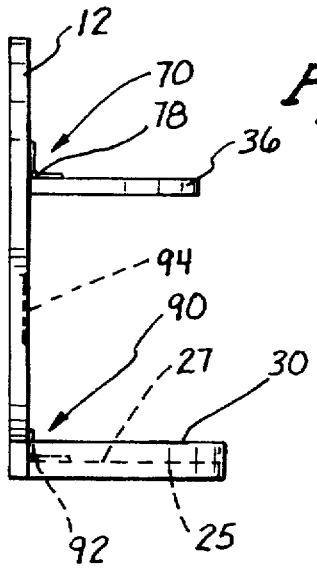
FIG. 8 is a side elevation view similar to FIG. 4 and illustrating a further embodiment of a collapsible target apparatus.
Figure 9:
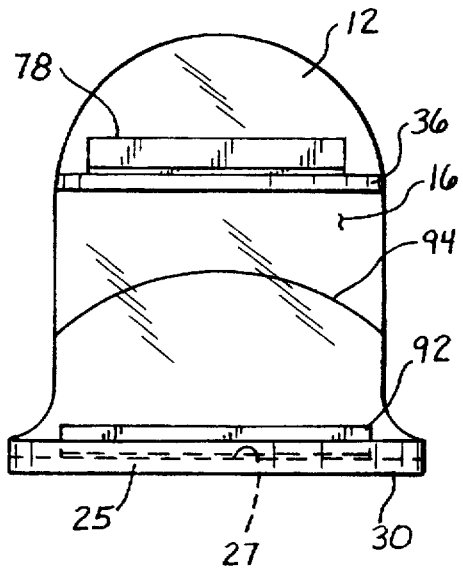
FIG. 9 is a front elevation view similar to FIG. 2 and illustrating a groove facilitating collapse of the apparatus illustrated in FIG. 8.
Figure 10:
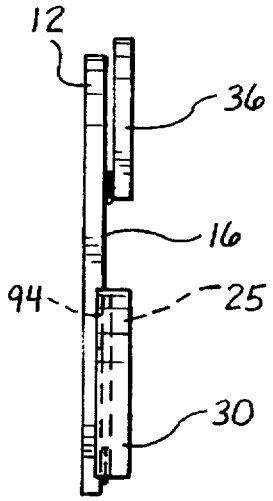
FIG. 10 is a side elevation view illustrating collapse of the embodiment of FIG. 8.

In an alternative embodiment illustrated in FIGS. 8–10, the apparatus can be formed to collapse into an even more compact parallel configuration. In this embodiment, the hinge 90 is disposed between the surface 27 of the panel 25 and the surface 16 of the panel 12. This hinge 90 includes a pivot pin 92 that is disposed along the intersection of these two surfaces 16 and 27. As the panel 25 is pivoted upwardly and counterclockwise in FIG. 8, it achieves a generally parallel orientation with the panel 12. A true parallel relationship is prevented by interference between the lip 30 which extends above the surface 27, and the panel 12. Even with this embodiment, a true parallel orientation between the panels 12 and 25 can be achieved by cutting a small semicircular groove 94 into the panel 12. This groove must be of the same size and shape as the strip 30 in order to accommodate the lip of the strip 30 when the panel 25 is in a true parallel orientation as illustrated in FIG. 10. The advantage of this embodiment is that the parallel orientation is only the width of two panels wide as illustrated in FIG. 10, as opposed to three panels wide as illustrated in FIG. 7. Furthermore, both of the panels 36 and 25 pivot into their operative positions in a clockwise direction and can benefit from the force of gravity to maintain their operative position as illustrated in FIG. 8. A separate retention strap 87 is not required for this embodiment.

Figure 11:
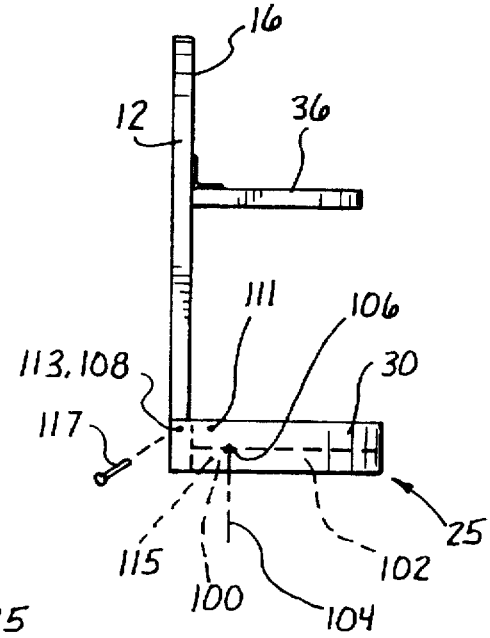
FIG. 11 is a side elevation view of a further embodiment of the invention illustrating the game apparatus in an operation configuration.
Figure 12:
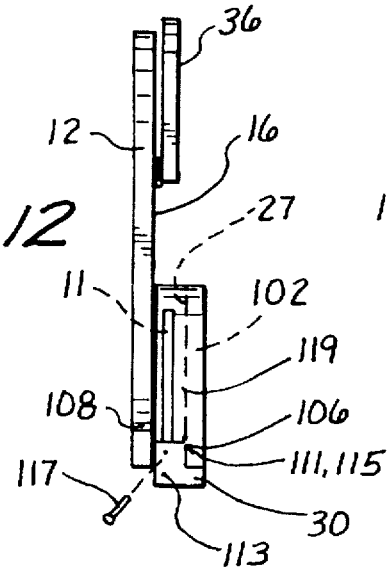
FIG. 12 is a side elevation of the embodiment of FIG. 11 illustrating the game apparatus in a compact transportation configuration.

A further embodiment of the invention, illustrated in FIGS. 11 and 12, is of particular advantage as it provides storage for the disks in a compact, transportable configuration. In FIG. 11, it can be seen that the tray or panel 25 can be divided into a section 100 and section 102 which in a preferred embodiment are separated along a plane 104 which is generally parallel to the panel 12. In this embodiment, the section 100 is fixed in a generally perpendicular relationship to the panel 12, and the section 102 is pivotal on a hinge 106 disposed between the section 100 and section 102. In this embodiment, it is important that the strip 30 be permanently attached only to the panel section 102. It is not permanently attached to either the panel 12 or the fixed panel section 100.

This strip 30, which extends around the panel 25 and above the surface 27, can be drilled to form two through-holes 108 and 111. The panel 12, and the panel section 100 can also be drilled to form holes 113 and 115, respectively. These holes 108, 111, 113 and 115 facilitate alignment and maintenance of the panel 25 in the two positions illustrated in FIGS. 11 and 12. In FIG. 11, the operative position of the panel 25 is shown with the panel section 102 extending in a generally parallel relationship with panel section 101 and in a generally perpendicular relationship with the support panel 12. In this position, the through-hole 108 in the strip 30 is aligned with the hole 113 in the support panel 12. A pin 117 can be disposed in the holes 108 and 113 to maintain this operative position of the panel 25.

Referring now to FIG. 12, it can be seen that when the pin 117 is removed, the panel section 102 can be easily pivoted about the hinge 106 into a generally parallel relationship with the support panel 12 and a generally perpendicular relationship with the panel section 100. It will be noted that in this compact, transportable configuration, the edge of the strip 130 comes into contact with the panel 12, thereby defining a cavity 119 between the surfaces 16 and 27 of the panel 12 and panel section 102, respectively. This cavity 119 is also defined by the strip 30 and the panel section 100. Of particular interest is the fact that the cavity 119 is of a perfect size to receive the disks 11 for storage and/or transportation. In the compact configuration illustrated in FIG. 12, the through-hole 111 in the strip 30 is aligned with the hole 115 in the panel section 100, so the pin 117 can be disposed in these holes 111, 115 to maintain the compact, transportable configuration.

The apparatus 10 is particularly adapted for use by a single individual in a confined space such as an office where the back panel 12 could be placed in juxtaposition to a wall or the bottom panel 25 could be supported on a table. The objects, such as the disks 11, could be stored on the surface 38 of the panel 36 which forms a shelf of the apparatus 10. A slot 56 could be cut in this surface 38 to receive the disk 11 when stored. Alternatively, the panel 36 could be cut to form round apertures adapted to receive objects such as spherical balls. With the apparatus 10 particularly adapted for use in an office or executive environment, the materials of choice will commonly include exotic woods such as oak, and shineable metals such as brass, nickel or chrome.

The apparatus 10 can also be used in pairs which are oriented to face each other, in which case, the game would be played by two opponents standing in proximity to their respective targets 10.

The apparatus 10 can also be adapted to function as a basket by cutting a large hole 61 through the top panel 36 as illustrated in FIG. 3. With such an hole, the apparatus 10 could be used as waste basket by wadding papers into balls 63 and attempting to throw the balls through the hole 61. In such an embodiment, the chains 47 providing the barrier 50 would also function to retain the paper balls 63 within the target region 43.

Although the invention has been disclosed with reference to specific embodiments, it will be apparent that many variations on this concept can be provided to accommodate a particular object, such as the disk 11. The elements, such as the chains 47, which form the barrier 50, can also vary widely along with mechanisms for tensioning those elements. Many different decision indicia such as that designated 54 in FIG. 6 can also be used within the concept of the invention. The shapes of the panels can also vary significantly to control the structural relationships between the chains 47 and the panels 36 and 25 forming the shelf and tray, respectively.

Given these wide variations, which are all within the scope of this concept, one is cautioned not to restrict the invention to the embodiments which have been specifically disclosed and illustrated, but rather encouraged to determine the scope of the invention only with reference to the following claims.

I claim:

1. A game apparatus adapted for use with objects to be thrown, comprising:

a primary panel having a first end and a second end;

a secondary panel disposed in proximity to the first end of the primary panel, the secondary panel extending in cantilevered relationship to the primary panel and forming a tray to receive the thrown objects;

a tertiary panel disposed in proximity to the second end of the primary panel, the tertiary panel having a perimeter region;

a plurality of elongate obstruction elements coupled to the perimeter region of the tertiary panel and extending into proximity with the secondary panel, the elongate objects forming a barrier and defining generally with the primary panel an interior region; whereby the objects can be thrown at the apparatus with the purpose of penetrating the barrier to reach the interior region of the apparatus.

2. The game apparatus recited in claim 1 wherein the obstruction elements comprise at least one chain.

3. The game apparatus recited in claim 1, wherein:

at least a portion of the secondary panel is pivotal with respect to the primary panel.

4. The game apparatus recited in claim 3 wherein the secondary panel includes:

a first panel section having a fixed relationship with the primary panel; and a second panel section having a pivotal relationship with respect to the primary panel and the first panel section of the secondary panel.

5. The game apparatus recited in claim 1, further comprising:

a tension mechanism attached to at least one of the obstruction elements.

6. The game apparatus recited in claim 3, further comprising:

a lip disposed around at least a portion of the secondary panel.

7. The game apparatus recited in claim 6 wherein portions of the primary panel define a groove sized and configured to receive the lip when the secondary panel is in a folded configuration.

8. A game apparatus adapted for use with objects to be thrown, comprising:

a support having a planar configuration, a first end and opposing second end;

a top panel coupled to the first end of the support and having a perimeter region;

a bottom panel coupled to the second end of the support in spaced relationship with the top panel;

a plurality of obstruction elements coupled to the perimeter region of the top panel and defining at least in part an interior region of the apparatus, the obstruction elements hanging from the top panel into proximity with the bottom panel; whereby the objects can be thrown at the apparatus with a purpose of penetrating the barrier to reach the interior region of the apparatus.

9. The game apparatus recited in claim 8 wherein the apparatus has an operative position and a compact position, and the apparatus further comprises:

the top panel having a first orientation in the operative position wherein at least a portion of the top panel is generally perpendicular to the support, and a second orientation in the compact position wherein the top panel is generally parallel to the support; and the bottom panel has a first configuration in the operative position wherein at least a portion of the bottom panel is generally perpendicular to the support, and a second orientation in the compact position wherein at least a portion of the bottom panel is generally parallel to the support.

10. The game apparatus recited in claim 9 further comprising a tension mechanism coupled to at least one of the obstruction elements.

11. The game apparatus recited in claim 9 wherein the bottom panel includes:

a first section coupled to the support and a second section coupled to the first section; the first section in the second orientation being generally perpendicular to the support; and the second section in the second orientation being generally parallel to the support.

12. The game apparatus recited in claim 8 wherein portions of the top panel define a hole.

13. The game apparatus recited in claim 12 wherein portions of the support define a groove.

14. A game apparatus adapted for use with objects to be thrown, comprising:

a support having a first end and opposing second end;

a top panel coupled to the first end of the support, the top panel having a first configuration and a perimeter region;

a bottom panel coupled to the second end of the support in spaced relationship with the top panel, the bottom panel having a second configuration different from the first configuration;

a plurality of obstruction elements coupled to the perimeter region of the top panel and extending into proximity with the bottom panel, the obstruction elements defining at least in part an interior region of the apparatus;

the first configuration of the top panel and the second configuration of the bottom panel being non-symmetrical about the support; and the first configuration of the top panel being smaller in size and similar in shape to the second configuration of the bottom panel.

15. The game apparatus recited in claim 14 wherein the support has a planar configuration.

16. The game apparatus recited in claim 14 wherein:

the first configuration of the top panel is a semicircle having a first radius;

the second configuration of the bottom panel is a semicircle having a second radius; and the first radius of the top panel is less than the second radius of the bottom panel.

17. The game apparatus recited in claim 16 wherein portions of the top panel define a hole.

18. The apparatus recited in claim 17 wherein portions of the support define a groove.

19. The game apparatus recited in claim 18 wherein portions of the top panel define a groove.

* * * * *